US012234582B2

(12) United States Patent
Lee

(10) Patent No.: US 12,234,582 B2
(45) Date of Patent: Feb. 25, 2025

(54) MULTI-COLOR JACQUARD DOUBLE-SIDED FABRIC

(71) Applicant: PAI LUNG MACHINERY MILL CO., LTD., New Taipei (TW)

(72) Inventor: Chih-Chiang Lee, New Taipei (TW)

(73) Assignee: PAI LUNG MACHINERY MILL CO., LTD., New Taipei (TW)

( * ) Notice: Subject to any disclaimer, the term of this patent is extended or adjusted under 35 U.S.C. 154(b) by 1 day.

(21) Appl. No.: 18/318,501

(22) Filed: May 16, 2023

(65) Prior Publication Data

US 2024/0384449 A1 Nov. 21, 2024

(51) Int. Cl.
*D04B 21/06* (2006.01)

(52) U.S. Cl.
CPC ..... *D04B 21/06* (2013.01)

(58) Field of Classification Search
CPC . D04B 1/126; D04B 1/10; D04B 1/26; D04B 7/26; D04B 7/28; D04B 9/28; D04B 9/34; D04B 9/36
USPC ..... 66/136, 137, 180
See application file for complete search history.

(56) References Cited

U.S. PATENT DOCUMENTS 1,619,788 A * 3/1927 Taubel ..... D04B 1/26 66/136
1,702,608 A * 2/1929 Lawson et al. ..... D04B 9/32 66/145 R
1,849,783 A * 3/1932 Beachman ..... D04B 11/00 66/178 R
2,150,773 A * 3/1939 Lawson ..... D04B 1/26 66/201
2,171,452 A * 8/1939 McAdams ..... D04B 1/26 D5/47
2,254,146 A * 8/1941 Holmes ..... D04B 9/38 66/201
4,019,350 A * 4/1977 Schmidt ..... D04B 1/102 66/196
5,979,193 A * 11/1999 Murata ..... D04B 1/126 66/60 R (Continued)

FOREIGN PATENT DOCUMENTS

CN 109965413 7/2019
CN 112981678 A * 6/2021 ..... D04B 1/102
CN 114108164 A * 3/2022

(Continued)

*Primary Examiner* — Danny Worrell
(74) *Attorney, Agent, or Firm* — MUNCY, GEISSLER, OLDS & LOWE, P.C.

(57) ABSTRACT

A multi-color jacquard double-sided fabric has a technical front and a technical back, and is formed by knitting at least four yarns. The at least four yarns are divided into a plurality of color-developing sets, each of the sets includes two of the at least four yarns. The multi-color jacquard double-sided fabric includes jacquard segments located on the technical front and formed by one of the color-developing sets, and color development of each of the jacquard segments is presented by at least one of the following: 1) at least one standard front plating formed by two of the four yarns included in one of the color-developing sets; 2) at least one interchanged front plating formed by two of the four yarns included in one of the color-developing sets. The technical back of the multi-color jacquard double-sided fabric is formed by knitting the at least four yarns.

8 Claims, 3 Drawing Sheets

(56) References Cited

U.S. PATENT DOCUMENTS

| | | | | |
|---|---|---|---|---|
| 2006/0144097 | A1* | 7/2006 | Langer | D04B 1/26<br>66/178 R |
| 2006/0223400 | A1* | 10/2006 | Yasui | D04B 1/16<br>442/304 |

FOREIGN PATENT DOCUMENTS

| | | | | | |
|---|---|---|---|---|---|
| CN | 111691053 | B | * | 4/2022 | D04B 1/102 |
| CN | 114622335 | A | * | 6/2022 | |
| DE | 102010017136 | A1 | * | 12/2011 | D04B 1/126 |

* cited by examiner

20

MULTI-COLOR JACQUARD DOUBLE-SIDED FABRIC

FIELD OF THE INVENTION

The invention relates to a multi-color jacquard double-sided fabric.

BACKGROUND OF THE INVENTION

When an existing double-sided knitted fabric is intended to be implemented in multiple colors, color dyeing after knitting is generally adopted, such as in CN109965413A. If it is implemented with yarn-dyed jacquards, the fabric weight and fabric thickness of the double-sided knitted fabric obviously do not meet the requirements of commercial fabrics. More specifically, when the current circular knitting machine uses yarn-dyed jacquard, it is implemented by feeding one colored yarn through one yarn feeder, in order to present four-color jacquard, a single knitting process needs to go through four yarn feeders, resulting in the problems of fabric weight and fabric thickness in the double-sided knitted fabric.

SUMMARY OF THE INVENTION

A main object of the invention is to solve the problems of fabric weight and fabric thickness existing in the current double-sided knitted fabrics that are directly knitted by a circular knitting machine to form multi-colors.

In order to achieve the above object, the invention provides a multi-color jacquard double-sided fabric having a technical front and a technical back. The multi-color jacquard double-sided fabric is formed by knitting at least four yarns, the at least four yarns are grouped into a plurality of color-developing sets, each of the color-developing sets includes two of the at least four yarns, the multi-color jacquard double-sided fabric includes a plurality of jacquard segments located on the technical front and formed by one of the color-developing sets, color development of each of the jacquard segments is presented by at least one of the following: 1) at least one standard front plating formed by two of the four yarns included in one of the color-developing sets; 2) at least one interchanged front plating formed by two of the four yarns included in one of the color-developing sets; the technical back of the multi-color jacquard double-sided fabric is formed by knitting the at least four yarns.

In one embodiment, in at least one of the plurality of color-developing sets, the two of the at least four yarns have different colors.

In one embodiment, the multi-color jacquard double-sided fabric includes a plurality of back plating on the technical back, and the back plating are formed by sequential knitting of the color-developing sets in turns.

In one embodiment, the back plated loops include at least one standard back plating and at least one interchanged back plating formed by one of the color-developing sets.

In one embodiment, the multi-color jacquard double-sided fabric included a plurality of connecting structures formed by two of the at least four yarns included in one of the color-developing sets used for color-developing of each of the jacquard segments.

Through the aforementioned implementation of the invention, compared with the prior art, the invention has the following characteristics: the multi-color jacquard double-sided fabric of the invention can have multi-color jacquards after knitting is completed. Through the multi-color jacquard double-sided fabric structure, the problems of fabric weight and fabric thickness existing in conventional fabric structures can be specifically improved. Fabric weight and fabric thickness of the multi-color jacquard double-sided fabric of the invention can be made to meet requirements of commercial use.

DETAILED DESCRIPTION OF THE PREFERRED EMBODIMENTS

The detailed description and technical content of the invention are described below with reference to the accompanying drawings.

Figure 1:
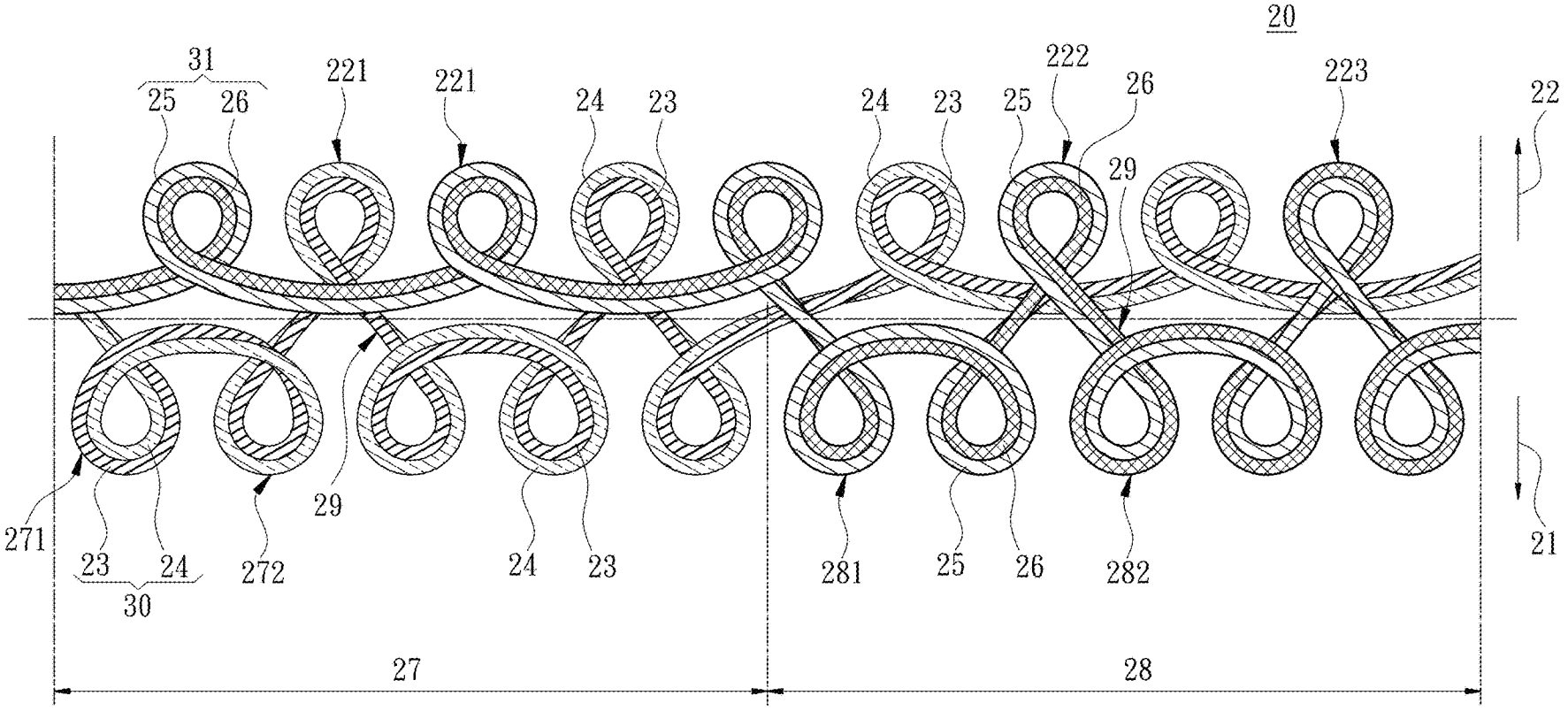
FIG. 1 is a schematic structural view of a first embodiment of a multi-color jacquard double-sided fabric of the invention.
Figure 2:
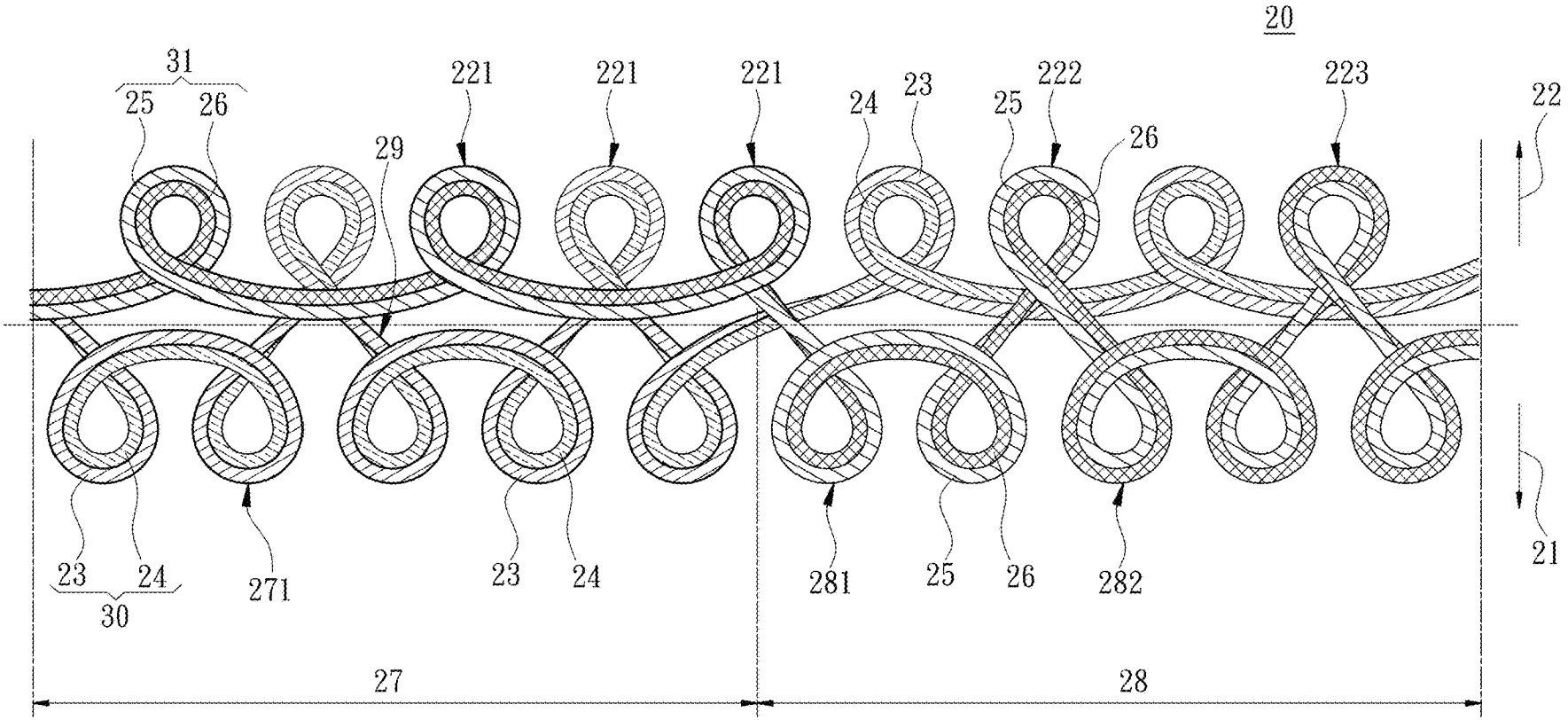
FIG. 2 is a schematic structural view of a second embodiment of the multi-color jacquard double-sided fabric of the invention.
Figure 3:
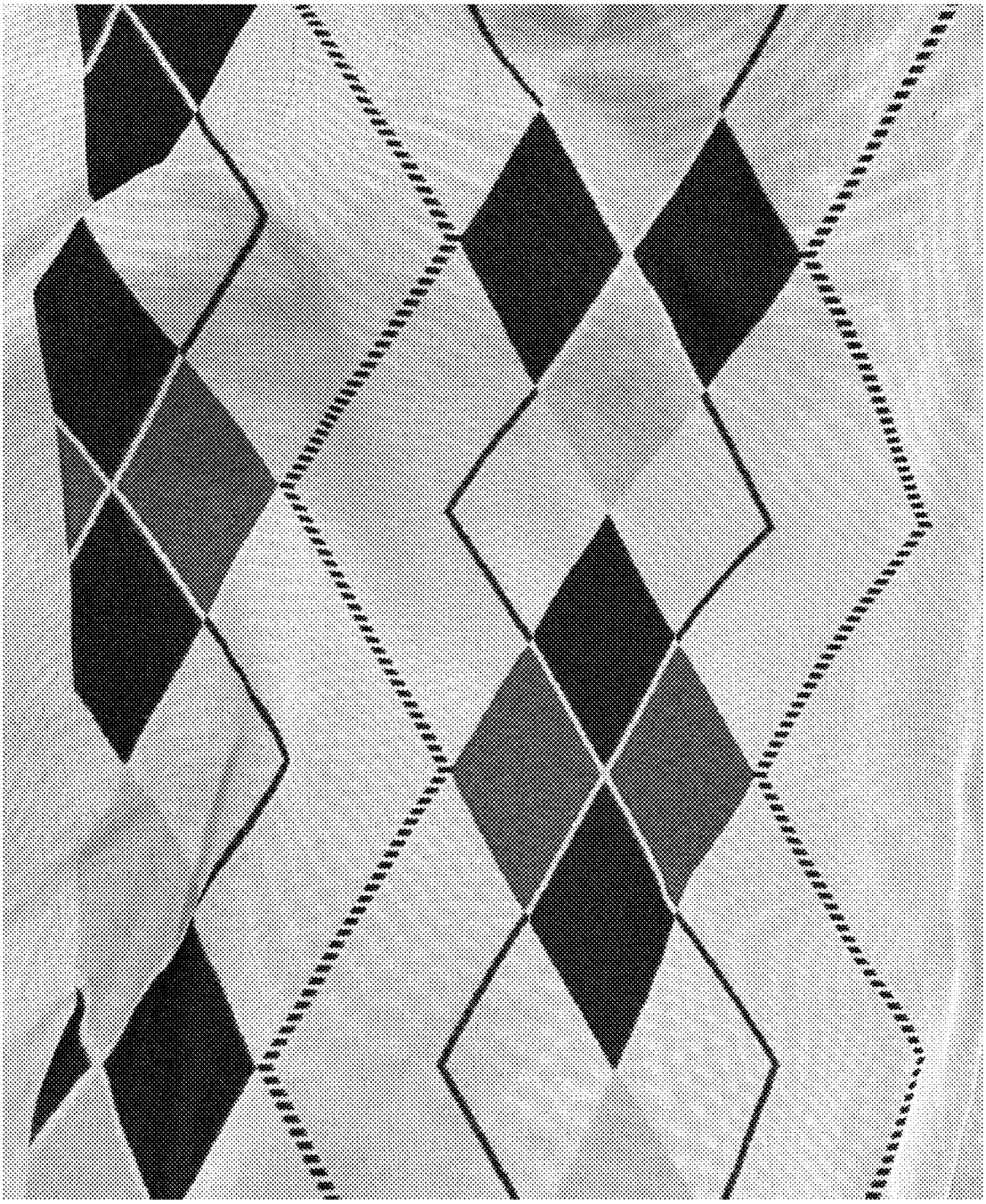
FIG. 3 is a jacquard schematic diagram of a technical front of the multi-color jacquard double-sided fabric of the invention.

Please refer to FIG. 1 and FIG. 2, the invention provides a multi-color jacquard double-sided fabric 20, and the multi-color jacquard double-sided fabric 20 is produced by knitting with a circular knitting machine. The multi-color jacquard double-sided fabric 20 has a technical front 21 and a technical back 22, the multi-color jacquard double-sided fabric 20 is formed by knitting at least four yarns 23, 24, 25, 26, and the at least four yarns 23, 24, 25, 26 are divided into a plurality of color-developing sets 30, 31. Each of the color-developing sets 30, 31 includes two of the at least four yarns 23, 24, 25, 26, and two of the at least four yarns 23, 24, 25, 26 included in each of the color-developing sets 30, 31 are supplied by a same yarn feeder on the circular knitting machine. For example, the two yarns 23, 24 of the at least four yarns 23, 24, 25, 26 are supplied by a same yarn feeder, and the other two yarns 25, 26 of the at least four yarns 23, 24, 25, 26 are supplied by another yarn feeder.

Please refer to FIG. 1 and FIG. 2 again, the multi-color jacquard double-sided fabric 20 includes a plurality of jacquard segments 27, 28 located on the technical front 21 and formed by one of the color-developing sets 30, 31. Color development of each of the jacquard segments 27, 28 is presented by at least one of the following: 1) at least one standard front plating 271, 281 formed by two of the at least four yarns 23, 24, 25, 26 included in one of the color-developing sets 30, 31; 2) at least one interchanged front plating 272, 282 formed by two of the at least four yarns 23, 24, 25, 26 included in one of the color-developing sets 30, 31. It should be understood that the color development mentioned above in this paragraph refers to what can be seen by direct observation of a surface of the technical front 21. Further, the circular knitting machine determines a form of loop plating of each of the jacquard segments 27, 28 through a setting of a knitting program. The at least one standard front plating 271, 281 means that positions of two of the at least four yarns 23, 24, 25, 26 included in one of the color-developing sets 30, 31 have not been changed during a knitting process, and are knitted in a same form when being fed. The at least one interchanged front plating 272, 282 means that positions of two of the at least four yarns 23, 24, 25, 26 included in one of the color-developing sets 30, 31 have been changed during a knitting process, forming a color development different from that of the at least one standard front plating 271, 281. As illustrated in FIG. 1 as an example, a left section of the jacquard segment 27 of the jacquard segments 27, 28 is implemented with the standard front plating 271 of the standard front plating 271, 281, and a right section of the jacquard segment 27 of the jacquard segments 27, 28 is implemented with the interchanged front plating 272 of the interchanged front plating 272, 282. If the two yarns 23, 24 of the at least four yarns 23, 24, 25, 26 included in the color-developing set 30 of at least one of the color-developing sets 30, 31 have different colors, the jacquard segment 27 of the jacquard segments 27, 28 will therefore produce a color change to realize yarn-dyed jacquard. In a second embodiment disclosed in FIG. 2, the jacquard segment 27 of the jacquard segments 27, 28 is implemented with the standard front plating 271, and the jacquard segment 28 of the jacquard segments 27, 28 is implemented with the standard front plating 281 and the interchanged front plating 282 to realize jacquard. Furthermore, positions and quantities of the at least one standard front plating 271, 281 and the at least one interchanged front plating 272, 282 in each of the jacquard segments 27, 28 are not fixed, but can be determined according to fabric design.

The technical back 22 of the multi-color jacquard double-sided fabric 20 of the invention is formed by knitting the at least four yarns 23, 24, 25, 26. That is to say, the technical back 22 has no knitting section distinction, and in each section of the technical back 22 corresponding to the jacquard segments 27, 28 of the technical front 21, the plated loops formed by the at least four yarns 23, 24, 25, 26 can be observed.

The at least four yarns 23, 24, 25, 26 used to knit the multi-color jacquard double-sided fabric 20 in the invention have different colors, and two of the at least four yarns 23, 24, 25, 26 included in each of the color-developing sets 30, 31 are fed by a same yarn feeder on the circular knitting machine. This yarn feeding mode is two-feeder-four-colors in the technical terms of this technical field. A structure of the multi-color jacquard double-sided fabric 20 of the invention in terms of fabric weight and fabric thickness is capable of meeting design requirements of commercial clothing compared with the prior art being only capable of knitting in four-feeder-four-colors. Further, colors of the at least four yarns 23, 24, 25, 26 of the invention can also be implemented in three colors in addition to implementing with four colors. When implemented with three colors, colors of two of the at least four yarns 23, 24, 25, 26 are the same, two of the at least four yarns 23, 24, 25, 26 can belong to one of the color-developing sets 30, 31, or belong to the color-developing sets 30, 31 respectively.

Please refer to FIG. 1 and FIG. 2 again, in one embodiment, the multi-color jacquard double-sided fabric 20 includes a plurality of back plating 221 on the technical back 22, and the back plating 221 are formed by sequential knitting of the color-developing sets 30, 31 in turns. That is to say, the back plating 221 are formed by knitting of the two yarns 23, 24 of the at least four yarns 23, 24, 25, 26 included in the color-developing set 30, and then followed by knitting of the two yarns 25, 26 of the at least four yarns 23, 24, 25, 26 included in the color-developing set 31. In some embodiments, the color-developing sets 30, 31 are formed sequentially in turns after each knitting with a needle. In one embodiment, the back plating 221 include at least one standard back plating 222 and at least one interchanged back plating 223 formed by one of the color-developing sets 30, 31. Positions of the at least one standard back plating 222 and the at least one interchanged back plating 223 are changed according to the plating loops of the technical front 21.

Please refer to FIG. 1 and FIG. 2 again, in one embodiment, the multi-color jacquard double-sided fabric 20 includes a plurality of connecting structures 29 formed by two of the at least four yarns 23, 24, 25, 26 included in one of the color-developing sets 30, 31 used for color-developing of each of the jacquard segments 27, 28. The connecting structures 29 connects knitted structures used for forming the technical front 21 and the technical back 22.

What is claimed is:

1. A multi-color jacquard double-sided fabric, having a technical front and a technical back, wherein the multi-color jacquard double-sided fabric is formed by knitting at least four yarns, the at least four yarns are grouped into a plurality of color-developing sets, each of the color-developing sets comprises two of the at least four yarns, the multi-color jacquard double-sided fabric comprises a plurality of jacquard segments located on the technical front and formed by one of the color-developing sets, color development of each of the plurality of jacquard segments is presented by at least one of the following:

at least one standard front plating formed by two of the four yarns comprised in one of the plurality of color-developing sets; and at least one interchanged front plating formed by two of the four yarns comprised in one of the plurality of color-developing sets; and wherein he technical back of the multi-color jacquard double-sided fabric is formed by knitting the at least four yarns.

2. The multi-color jacquard double-sided fabric as claimed in claim 1, wherein in at least one of the plurality of color-developing sets, the two of the at least four yarns have different colors.

3. The multi-color jacquard double-sided fabric as claimed in claim 1, wherein the multi-color jacquard double-sided fabric comprises a plurality of back plating on the technical back, and the back plating are formed by sequential knitting of the color-developing sets in turns.

4. The multi-color jacquard double-sided fabric as claimed in claim 3, wherein the plurality of back plating comprise at least one standard back plating and at least one interchanged back plating formed by one of the plurality of color-developing sets.

5. The multi-color jacquard double-sided fabric as claimed in claim 3, wherein the multi-color jacquard double-sided fabric comprises a plurality of connecting structures formed by the two of the at least four yarns comprised in one of the plurality of color-developing sets used for color-developing of each of the plurality of jacquard segments.

6. The multi-color jacquard double-sided fabric as claimed in claim 5, wherein the plurality of back plating comprise at least one standard back plating and at least one interchanged back plating formed by one of the plurality of color-developing sets.

7. The multi-color jacquard double-sided fabric as claimed in claim 1, wherein the multi-color jacquard double-sided fabric comprises a plurality of connecting structures formed by the two of the at least four yarns comprised in one of the plurality of color-developing sets used for color-developing of each of the plurality of jacquard segments.

8. The multi-color jacquard double-sided fabric as claimed in claim 1, wherein the multi-color jacquard double-sided fabric comprises a plurality of back plating on the technical back, the plurality of back plating comprise at least one standard back plating and at least one interchanged back plating formed by one of the plurality of color-developing sets.

* * * * *